US005258772A

United States Patent [19]

Inanaga et al.

[11] Patent Number: 5,258,772

[45] Date of Patent: Nov. 2, 1993

[54] ANTENNA DEVICE

[75] Inventors: Masayuki Inanaga; Shouichirou Okuda, both of Fukuoka, Japan

[73] Assignee: Matsushita Electric Industrial Co., Ltd., Osaka, Japan

[21] Appl. No.: 773,878

[22] PCT Filed: Apr. 1, 1991

[86] PCT No.: PCT/JP91/00429

§ 371 Date: Nov. 4, 1991

§ 102(e) Date: Nov. 4, 1991

[87] PCT Pub. No.: WO91/15876

PCT Pub. Date: Oct. 17, 1991

[30] Foreign Application Priority Data

Apr. 4, 1990 [JP] Japan ..... 2-89918

[51] Int. Cl.[5] ..... H01Q 1/36; H01Q 1/24

[52] U.S. Cl. ..... 343/895; 343/702

[58] Field of Search ..... 343/702, 749, 750, 752, 343/889, 895, 900, 901, 903

[56] References Cited

U.S. PATENT DOCUMENTS

| | | | |
|---|---|---|---|
| 2,222,527 | 11/1940 | Boughter | 343/901 |
| 2,491,629 | 12/1949 | Vernier | 343/901 |
| 2,875,442 | 2/1959 | Benis et al. | 343/715 |
| 2,913,073 | 11/1959 | Wendling | 343/901 |
| 3,254,344 | 5/1966 | Rohrs | 343/901 |
| 3,359,559 | 12/1967 | Guinn | 343/901 |
| 3,587,103 | 6/1971 | Lawrie et al. | 343/900 |
| 4,021,809 | 5/1977 | Klancnik | 343/900 |
| 4,139,852 | 2/1979 | Koyanagi | 343/903 |
| 4,385,849 | 5/1983 | Crain | 343/901 |

FOREIGN PATENT DOCUMENTS

| | | | |
|---|---|---|---|
| 0343847 | 11/1989 | European Pat. Off. . | |
| 2510825 | 9/1976 | Fed. Rep. of Germany | 343/895 |
| 0109357 | 8/1979 | Japan | 343/900 |
| 0660913 | 11/1951 | United Kingdom | 343/900 |

*Primary Examiner*—Michael C. Wimer
*Assistant Examiner*—Tan Ho
*Attorney, Agent, or Firm*—Pollock, VandeSande & Priddy

[57] ABSTRACT

This invention provides an antenna device of the type including a main antenna composed of a retractable flexible antenna, wherein the main antenna is slidably received in a tubular antenna case, a coil spring composed of a conductor is connected at one end to a base of the main antenna and, at an opposite end, to the antenna case, and holding means disposed on the base of the main antenna for holding the main antenna against displacement. With this arrangement, when the main antenna is retracted in the antenna case, the coil spring is contracted. The contracted coil spring serves as a short antenna coil so that the necessary antenna characteristics can be maintained even when the main antenna is received inside the antenna case. The antenna device can be transported while it is received in a pocket or the like of the user, with the main antenna kept in a retracted position, and with its receiver function kept in an activated condition.

4 Claims, 2 Drawing Sheets

ANTENNA DEVICE

TECHNICAL FIELD

This invention relates to an antenna device.

BACKGROUND ART

Antennas incorporated for radio wave radiation in handy-type compact radio communication equipment, movable units of cordless telephone sets, etc. include a telescopic rod antenna which is used from the point of view of portability, transportation and storage, and a flexible antenna which is used from the point of view of protection of the antenna body against damage.

FIGS. 3 and 4 show a radiotelephone equipped with a conventional flexible antenna which can be received in a body of the radiotelephone. In this figure, numeral 31 is a flexible antenna having an internal spiral conductor 32, numeral 34 is a stopper provided at the base of the flexible antenna, and numeral 35 is a bearing provided within a cabinet 38 for slidably holding the flexible antenna 31. Thus, the flexible antenna 31 is slidably supported by the bearing 35 and is protected by the stopper 34 against removal from the cabinet 38. Numeral 36 is an electrode strip provided on the base of the flexible antenna 31. The electrode strip 36 and the internal spiral conductor 32 are held in conduction with each other. Numeral 37 is an electrode strip secured to the bearing 35. When the flexible antenna 31 is pulled out as shown in FIG. 3, the electrode strip 36 and the electrode strip 37 contact with each other, thereby electrically connecting the spiral conductor 32 and transmitter and receiver circuits (not shown).

In the unused condition, the flexible antenna 31 is received within the cabinet 38, as shown in FIG. 4. In use, the user pulls out the flexible antenna 31 from the cabinet 38 while gripping the front end of the flexible antenna 31. When the flexible antenna 31 is fully extended, the electrode strip 36 on the flexible antenna side is brought into contact with the electrode strip 37 secured to the bearing 35, whereupon the transmitter and receiver circuits and the spiral conductor 32 are electrically connected with each other.

With this construction, transmission and reception of a message is not possible until the flexible antenna 31 is fully pulled out from the cabinet, as shown in FIG. 3.

In some instances, however, it is desired that a receiver function is kept alive even when the antenna is received in the cabinet. This is because it is very convenient for the user if the radiotelephone has a construction enabling such a manner of use that the radiotelephone is held compactly in a pocket or the like of the user while keeping the receiver function in an activated condition, and when a call signal is received, the user draws the radio-telephone from the pocket and pulls out the antenna from the cabinet for commencing transmission of a message. To realize this manner of use, however, a receive-only sub-antenna which is operable in the received condition must be provided within the cabinet in addition to the main antenna. Furthermore, in order to connect the transmitter and receiver circuits selectively with the main antenna and the sub-antenna depending on the position of the main antenna, a switching means must be provided. Thus, the above-mentioned arrangement increases the number of structural components of the radiotelephone.

Furthermore, when the antenna of the construction shown in FIG. 3 is depressed during transmission of a message, connection between the antenna and the transmitter circuit is interrupted for a moment. In this instance, the impedance and the resonance frequency of the antenna side as viewed from the transmitter circuit change greatly. If such a great change in impedance and resonance frequency occurs during the transmission of a message, the transmitter circuit may be damaged.

The currents flowing between the transmitter circuit and the main antenna and also between the transmitter circuit and the sub-antenna are high-frequency currents in a radio frequency band. Contacts of the switching means must be disposed at portions through which the high-frequency currents flow. In order to minimize a high-frequency current loss, an expensive switching means is needed, which will increase the manufacturing cost of the radiotelephone.

DISCLOSURE OF THE INVENTION

This invention was made in view of the foregoing problems, and is to provide an antenna device which is equipped with a retractable flexible antenna as a main antenna, is capable of maintaining a receiver function even when the flexible antenna is retracted, and can be manufactured at a low cost and is highly reliable in operation.

An antenna device according to this invention comprises a main antenna slidably received in a tubular antenna case, a coil spring composed of a conductor and secured at one end to a base portion of the main antenna and, at an opposite end, to the antenna case, and holding means disposed on the base portion and engageable in pressure contact with an inner wall of the antenna case for holding the main antenna in position against displacement.

With this construction, when the main antenna is retracted into the antenna case, the coil spring is contracted. The coil spring formed from a conductor has electric qualities of a coil. The inductance of the coil increases when the coil is contracted. Thus, the coil spring serves as a short antenna coil by means of which the necessary characteristic of the antenna can be maintained even when the main antenna is held in its retracted position. Consequently, the user is able to carry the radiotelephone while holding it in a pocket or the like, with the main antenna received in a body of the radiotelephone, and with a receiver function kept alive. The receive-only built-in antenna and the switching means described above are no longer needed, so that a high reliable antenna device can be obtained at a low cost.

BEST MODE FOR CARRYING OUT THE INVENTION

An embodiment of this invention will be described below with reference to the accompanying drawings.

Figure 1:
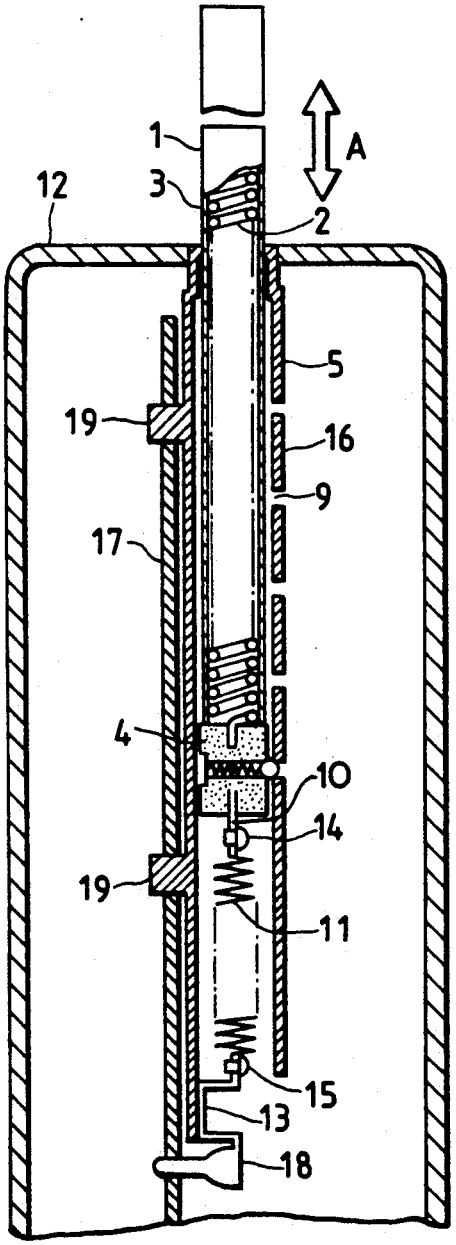
FIG. 1 is a cross-sectional view of an antenna device according to an embodiment of this invention.

FIG. 1 is a cross-sectional view of an antenna mounting portion of a cordless telephone having a retractive flexible antenna. In FIG. 1, numeral 1 is a flexible antenna composed of a spiral conductor 2 covered with a sheath 3. Numeral 4 is a slide member provided at a base of the flexible antenna 1. Numeral 5 is an antenna case constructed into a tubular form in which the flexible antenna 1 is slidably received and movable longitudinally in the direction indicated by the arrow A.

Figure 2:
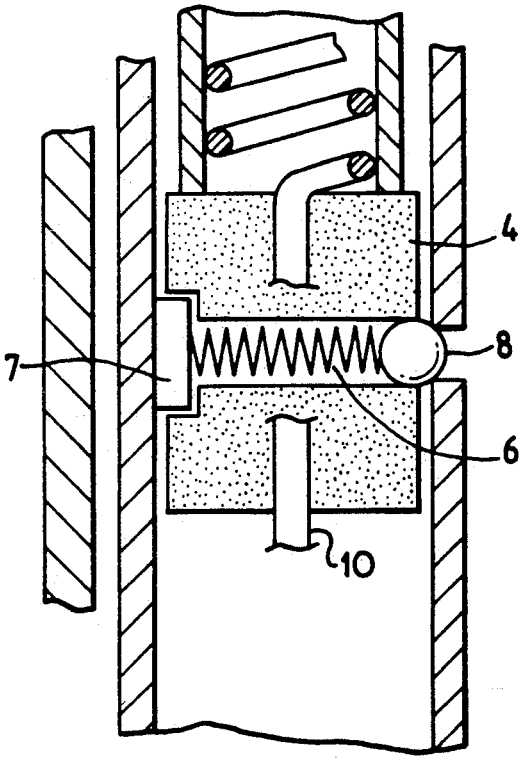
FIG. 2 is a cross-sectional view of a main portion of the antenna device.
Figure 3:
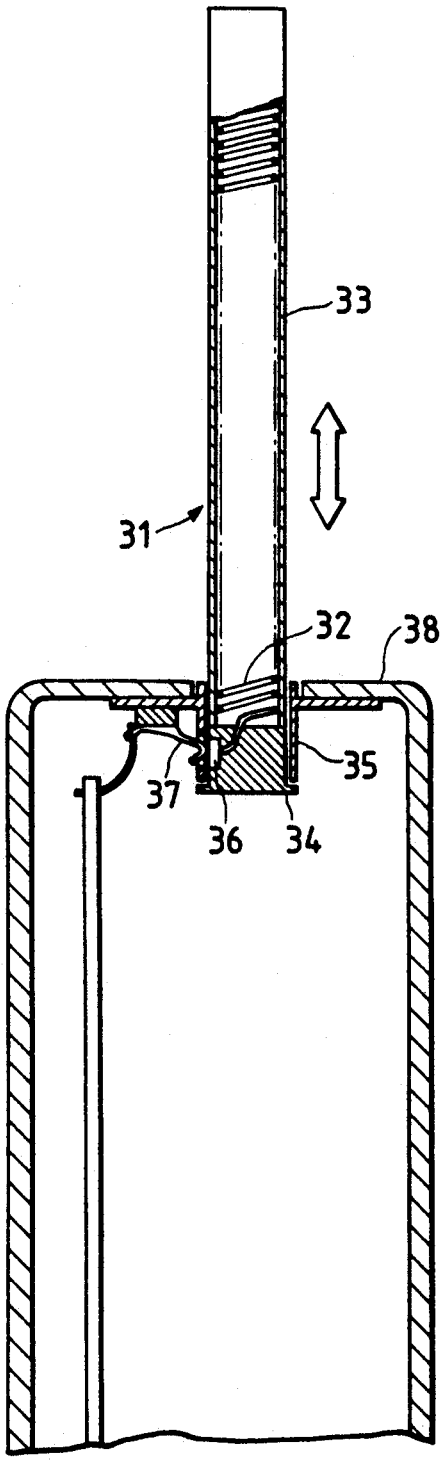
FIG. 3 PRIOR ART
FIG. 3 is a cross-sectional view of an antenna device having a conventional flexible antenna being used.
Figure 4:
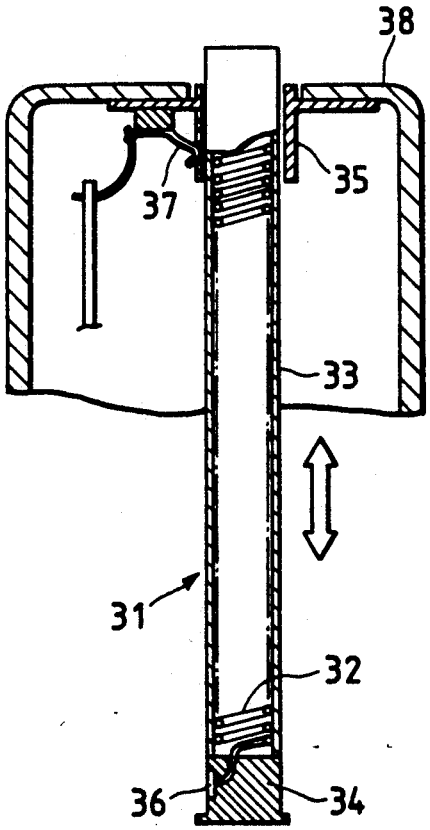
FIG. 4 PRIOR ART
FIG. 4 is a cross-sectional view of the conventional antenna device shown in a retracted condition.

FIG. 2 shows structural details of the slide member 4. Numeral 6 is a spring, 7 is a friction plate, and 8 is an iron ball. The iron ball 8 is disposed on one side of the slide member 4 while the friction plate 7 is disposed on the opposite side of the slide member 4. The spring 6 is received in a through-hole formed in the slide member 4 and urges the iron ball 8 and the friction plate 7 away from one another. The friction plate 7 is, therefore, forced against an inner wall of the antenna case 5 to produce a friction force therebetween.

Numeral 9 is one of plural holes formed in an inner wall of the antenna case 5. The holes 9 are arranged along the longitudinal direction of the antenna case 5. The iron ball 8 is urged toward the inner wall of the antenna case 5 so that the iron ball 8 can be fitted in each of the holes 9.

The spiral conductor 2 has a base portion formed straight. The straight base portion extends through the slide member 4 and has a front end constituting an electrode portion 10.

Numeral 11 is a coil spring for urging the flexible antenna 1 inwardly, that is, in such a direction as to pull the flexible antenna 1 into the antenna case 5. One end of the coil spring 11 is secured by a screw 14 to the electrode portion 10 so that the coil spring 11 and the spiral conductor 2 are electrically connected together. Numeral 13 is a fastening metal disposed at an end of the antenna case 5. The opposite end of the coil spring 11 is secured by a screw 15 to the fastening metal 13 so that the coil spring 11 and the fastening metal 13 are electrically connected together.

The above-mentioned part, namely a part composed of the flexible antenna 1, the slide member 4, the antenna case 5, the coil spring 11 and the fastening metal 13 is called an antenna unit 16.

Numeral 17 is a printed circuit board having formed thereon a transmitter and a receiver circuit, etc. (not shown). Numeral 18 is a terminal pin formed integrally with the fastener metal 13. The terminal pin 18 is soldered with a conductor foil on a printed circuit board 17 so that it is electrically connected with the transmitter and receiver circuits formed on the printed circuit board 17. Bosses 19 projecting from the antenna case 5 are fitted with holes formed in the printed circuit board 17 so as to secure the antenna unit 16 to the printed circuit board 17.

Hereinafter, a description will be given of the procedure for assembling the antenna unit.

Firstly, the flexible antenna 1 is attached to the slide member 4. Then, the electrode portion 10 of the slide member is connected by the screw 14 to the coil spring 11, and the fastening metal 13 is connected by the screw 15 to the coil spring 11. Thereafter, the flexible antenna 1 is inserted into the antenna case 5. In this instance, the iron ball 8, the spring 6 and the friction plate 7 are also inserted into the antenna case 5 while they are held in an assembled condition within the hole in the slide member 4, as shown in FIG. 2. Subsequently, the coil spring 11 and the fastening metal 13 are inserted in sequence into the antenna case 5, and the fastening metal 13 is thereafter attached to the antenna case 5. Then, after the antenna case 5 with parts received therein is attached to the printed circuit board 17, the terminal pin 18 is soldered to a conductor foil on the printed circuit board 17. Finally, the printed circuit board 17 with the antenna unit 16 attached thereto is inserted into a cabinet 12.

Hereinafter, a description will be given of the operation of the antenna unit mentioned above. The flexible antenna 1 is slidable in the direction of the arrow A within the antenna case 5, as described above. In response to the movement of the flexible antenna 1, the coil spring 11 undergoes axial expansion and contraction. The expandable and contractible coil spring 11 forms a part of the antenna. When the flexible antenna 1 is received in the cabinet 12, the coil spring 11 is contracted. The thus-contracted coil spring 11 means that the inductance of the coil spring 11 is increased. The coil spring 11 having such an larger inductance serves as a short antenna coil.

POSSIBILITY OF INDUSTRIAL UTILIZATION

As described above, since the coil spring serves as a short antenna coil, the impedance and the resonance frequency of the antenna side as viewed from the transmitting circuit do not change greatly even when the length of the antenna is shortened by retracting the flexible antenna 1 into the cabinet 12. The necessary characteristics of the antenna can, therefore, be maintained. As a consequence, radio waves can be caught or received even when the flexible antenna 1 is received in the cabinet 12.

Furthermore, the slidable main antenna, namely the flexible antenna 1 is always connected to the transmitter and receiver circuits of the printed circuit board 17 via the coil spring 11. This arrangement obviates the intervention of a contact terminal and thereby eliminates an imperfect contact problem.

When the receive mode is shifted to the transmission mode, the user pulls out the flexible antenna 1 while gripping the front end of the flexible antenna 1. The flexible antenna 1, as it is withdrawn from the antenna case 5, extends the coil spring 11 whereupon the coil spring 11 due to its resiliency creates a force tending to pull the flexible antenna 1 back into the antenna case 5. In this instance, the iron ball 8 fits in one of the holes 9 to lock the slide member 4 against movement relative to the antenna case 5, thereby holding the flexible antenna in an extended position. The friction plate 7 which is provided on the opposite side to the iron ball 8 is forced against the inside wall of the antenna case 5, generating an adequate friction between the friction plate 7 and the antenna case 5.

During movement, the iron ball 8 makes a click each time when it snaps into one of the holes 9 in the antenna case 5. With the click stop thus provided, the flexible antenna 1 can be displaced with a relatively small force.

We claim:

1. An antenna device comprising;

a flexible antenna having a spiral conductor;

guide means for slidably guiding said antenna, said antenna being movable relative to said guide means between an extended position in which said antenna is substantially fully extended outwardly from said guide means, and a retracted position in which said antenna is substantially fully received in said guide means;

a resilient coil composed of a conductor and electrically connecting said antenna directly with an electric circuit, said resilient coil normally urging said antenna toward said retracted position, said resilient coil being resiliently deformable in response to the movement of said antenna when said antenna moves between said extended position and said retracted position; and means for holding said antenna in position against displacement relative to said guide means.

2. An antenna device comprising:

a flexible antenna having a spiral conductor;

a tubular antenna case for slidably receiving therein said antenna, said antenna being slidably movable relative to said tubular antenna case between an extended position in which said antenna is substantially fully extended outwardly from said tubular antenna case, and a retracted position in which said antenna is substantially fully received in said tubular antenna case;

a resilient coil composed of a conductor and secured at one end to a base of said antenna and, at an opposite end, to said antenna case, said resilient coil normally urging said antenna toward said retracted position, said resilient coil being resiliently deformable in response to the movement of said antenna when said antenna moves between said extended position and said retracted position; and means for holding said antenna in an extended condition against a resilient force of said resilient coil.

3. An antenna device as defined in claim 2, wherein said tubular antenna case has a plurality of holes formed in an inner wall thereof and arranged in a longitudinal direction of said tubular antenna case, wherein said holding means comprises a stopper disposed at a base of said antenna and retractably movable into said holes, and a spring urging said stopper against said inner wall, so that when said antenna moves between said extended position and said retracted position, said stopper is able to fit in one of said holes under the force of said spring, thereby releasably locking said antenna in position against the force of said resilient coil.

4. An antenna device comprising:

a flexible antenna having a spiral conductor;

a tubular antenna case for slidably receiving therein said antenna, said antenna being slidably movable relative to said tubular antenna case between an extended position in which said antenna is substantially fully extended outwardly from said tubular antenna case, and a retracted position in which said antenna is substantially fully received in said tubular antenna case;

a resilient coil composed of a conductor and secured at one end to a base of said antenna and, at an opposite end, to said tubular antenna case, said resilient coil normally urging said antenna toward said retracted position, said resilient coil being resiliently deformable in response to the movement of said antenna when said antenna moves between said extended position and said retracted position;

a friction member disposed at a base of said antenna; and a spring urging said friction member against an inner wall of said tubular antenna case for frictionally holding said antenna in position against displacement relative to said tubular antenna case.

* * * * *